US007104109B2

(12) United States Patent
Wasilewski

(10) Patent No.: US 7,104,109 B2
(45) Date of Patent: Sep. 12, 2006

(54) DOUBLE-CAVITY HEADING DIE

(75) Inventor: Bruce C. Wasilewski, Charlevoix, MI (US)

(73) Assignee: D-M-E Company, Madison Heights, MI (US)

( * ) Notice: Subject to any disclaimer, the term of this patent is extended or adjusted under 35 U.S.C. 154(b) by 743 days.

(21) Appl. No.: 10/895,462

(22) Filed: May 8, 2003

(65) Prior Publication Data

US 2006/0123877 A1 Jun. 15, 2006

(51) Int. Cl.
*B21D 31/00* (2006.01)
*B21J 13/02* (2006.01)

(52) U.S. Cl. ..... 72/477; 470/137; 470/183; 470/191; 470/192; 76/107.1; 76/107.4

(58) Field of Classification Search ..... 76/107.1, 76/107.4; 470/137, 183, 191, 192; 72/476, 72/477, 481
See application file for complete search history.

(56) References Cited

U.S. PATENT DOCUMENTS 1,449,136 A * 3/1923 Yates ..... 72/477
2,544,302 A * 3/1951 Duncan ..... 76/107.1
2,568,440 A * 9/1951 Friedman ..... 76/107.1
3,169,257 A * 2/1965 Loos et al. ..... 470/25
3,191,204 A * 6/1965 McClellan et al. ..... 470/191
3,937,053 A * 2/1976 Akamatsu ..... 470/191
4,094,185 A * 6/1978 Wang ..... 72/477

* cited by examiner

*Primary Examiner*—David Jones
(74) *Attorney, Agent, or Firm*—John W. Gregg; Stephen H. Friskney

(57) ABSTRACT

A cold or hot-forging heading die used in metalworking to form a "head" on the end of a metal rod is configured to provide two heading cavities formed in opposite ends of the carbide insert. The heading die of the invention comprises a hardened steel ring with a cylindrical carbide insert having a through bore with a first cavity machined concentrically with the bore in one end of the carbide insert. The die is then inverted and a second cavity formed in the opposite end of the insert. The second cavity can be identical to the first cavity or provide the shape for an alternate head configuration.

5 Claims, 1 Drawing Sheet

DOUBLE-CAVITY HEADING DIE

BACKGROUND OF THE INVENTION

1. Field of the Invention

The present invention relates to a heading die. More particularly, the present invention relates to a hot-forging heading die used in metalworking to form a "head" on the end of a steel rod, such as in the manufacture of ejector pins.

2. Description of the Related Art

Heading dies have long been used in cold and hot forging metalworking processes to form an enlarged "head" on the end of a metal rod that will define an element of the finished part. For example, a number of components used in the construction of injection molds, such as ejector pins, core pins, return pins, valve pins, and sleeves, as well as many non-molding industry parts such as screws, bolts, rivets, etc., are typically configured to have an elongated body with a head at one end to limit travel, orient the component or provide a finished or partially formed end for further machining processes.

The typical construction of a heading die comprises a hardened steel ring with a cylindrical carbide insert. Pre-forming the internal configuration during the manufacture of the carbide insert and/or normal machining methods are used to create an axial bore completely through the insert, the rod or body of the part passing through this bore during the forging process. The heading cavity is created by machining a suitably sized counterbore (concentric with the axial through bore) that will ultimately form the head during the cold or hot forging process. The prior art heading dies used for this purpose have a cavity on only one side of the die. Accordingly, when the insert became chipped, otherwise damaged or worn beyond acceptable tolerances, the die became unusable, necessitating its complete replacement by a new die.

SUMMARY OF THE INVENTION

The present invention overcomes the shortcomings of prior art constructions by providing a die configuration that includes two heading cavities formed in opposite ends of the carbide insert. The heading die of the invention comprises a hardened steel ring with a cylindrical carbide insert, as known in the art. The through bore and first cavity are likewise finished or created according to normal machining and metal-forming methods. The die is then inverted during the machining process and a second cavity formed in the opposite end of the insert. The second cavity can be identical to the first cavity or manufactured to provide the shape for an alternate head configuration.

This double-cavity construction of the present invention increases the utility and economy of the heading die. More specifically, the cost per cavity is reduced by nearly fifty percent compared to the prior art since a single carbide insert is used for both cavities. The only additional machining is for the second heading cavity since the through hole for the stem (rod) of the part has to be machined completely through the carbide insert even in a single cavity die.

DESCRIPTION OF THE PREFERRED EMBODIMENTS

Figure 1:
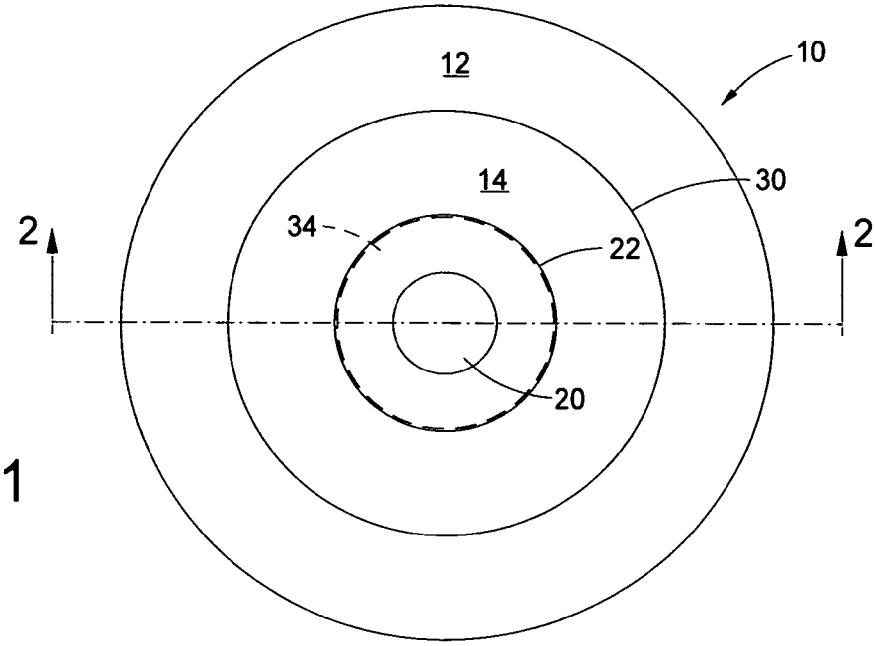
FIG. 1 is a top view of a portion of a double cavity heading die in accordance with the present invention.
Figure 2:
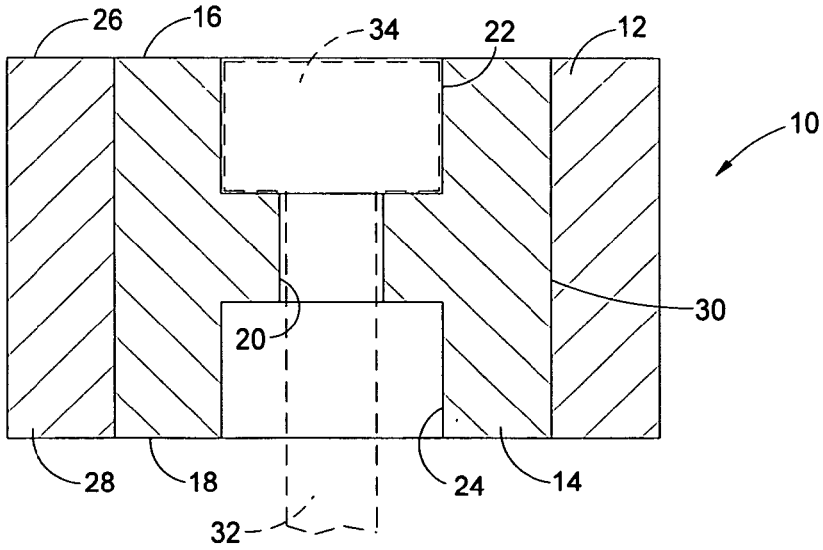
FIG. 2 is a cross-sectional view of the heading die in accordance with the present invention, taken along the line 2—2 of FIG. 1.
Figure 3:
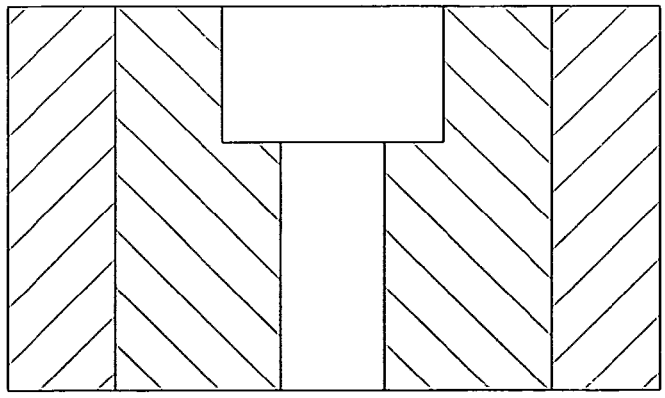
FIG. 3 (Prior Art)
FIG. 3 is a cross-sectional view showing the construction of a heading die as taught by the prior art.

Referring first to FIGS. 1 and 2 of the drawings, there is shown a heading die 10 in accordance with the present invention. The heading die 10 comprises a tubular support ring 12, preferably made from a hardened steel, such as H-13 tool steel, with a hardness of 45–50 Rc. A cylindrical insert 14 made of a suitable grade of tungsten carbide is received with the support ring 12. More specifically, the insert 14 has an outer diameter of a size that will create a "press-fit" with the support ring 12, ideally a class FH3 interference fit between the insert 14 and support ring 12. The insert 14 has opposing upper and lower end surfaces 16, 18 that fit flush with the associated end surfaces 26, 28 of the support ring 12. For some die configurations, the insert 14 may have certain internal geometry preformed, as is known in the industry, to save on material costs and minimize subsequent machining, as described in the following paragraphs.

The insert 14 undergoes a suitable machining process to create an axial bore 20 that extends entirely through the length if the insert 14. A first heading cavity 22 is then machined in the upper end surface 16 of the insert 14. As illustrated in the drawing, the first heading cavity 22 is concentric with the axial bore 20, so that both the first cavity 22 and axial bore 20 are concentric with the outer diameter 30 of the insert 14.

After the first heading cavity 22 is properly formed, the heading die 10 is inverted in the during the machining process, so that the lower end surface 18 of the insert 14 is accessible for the final machining operation. In particular, a second heading cavity 24 is machined in the lower end surface 18 of the insert 14. As with the first heading cavity 22, the second heading cavity 24 is concentric with the axial bore 20 and the outer diameter 30 of the insert 14. It is generally desirable for the second heading cavity 24 to have the same geometry as the first heading cavity 22 to facilitate maximum utility during the manufacturing process, as described in more detail below.

In its finished form, the heading die 10 is suitable for use in a cold or hot forging metalworking process wherein a metal rod or sleeve used to form a part having an elongated body portion 32 and an enlarged head portion 34, as shown in FIG. 2. When the upper end surface 16 and/or the first heading cavity 24 become chipped or otherwise damaged after repeated use to form numerous such parts, the heading die 10 is simply inverted in the forging press to expose the lower end surface of the insert 14, thereby making the second heading cavity 24 available for use. With the construction of the present invention, the heading die 10 is capable of producing essentially twice as many parts as the prior art heading dies.

The foregoing discussion and the illustrated embodiment of the invention have been in the context of the use of the heading die in conjunction with the manufacture of an ejector pin. However, it will be apparent to those skilled in the art that various changes and modification can be made without departing from the concepts of the present invention, allowing it to be used in the manufacture of numerous products. For example, while the heading die 10 is shown to have first and second cavities with identical shapes, it may be desirable under some circumstances to have a different geometry for the second cavity. It is therefore intended to encompass within the appended claims all such changes and modification that fall within the scope of the present invention.

What is claimed is:

1. A heading die comprising:

a) a tubular support ring;

b) a generally cylindrical carbide insert of a size to be received within the support ring, the carbide insert having upper and lower end surfaces and an axial bore through the length of the insert;

c) a first heading cavity formed in the upper end surface of the insert so that the first heading cavity is concentric with the axial bore of the insert; and d) a second heading cavity formed in the lower end surface of the insert so that the second heading cavity is also concentric with the axial bore of the insert, such that the second heading cavity can be used in place of the first heading cavity by inverting the heading die.

2. A heading die in accordance with claim 1, wherein the second heading cavity has a geometry substantially identical to the first heading cavity.

3. A heading die in accordance with claim 1, wherein the second heading cavity has a geometry that is substantially different to the first heading cavity.

4. A heading die in accordance with claim 1, wherein the die is suitable for use in both hot forging and cold forging applications.

5. A method of manufacturing a heading die comprising the steps of:

a) providing a hardened steel tubular support ring;

b) fitting a generally cylindrical, internally preformed in certain cases, carbide insert tightly within the support ring, the carbide insert having upper and lower end surfaces;

c) machining or finishing a preformed axial bore through the length of the insert;

d) machining or finishing a preformed first heading cavity in the upper end surface of the insert so that the first heading cavity is concentric with the axial bore of the insert; and e) machining or finishing a preformed second heading cavity in the lower end surface of the insert so that the second heading cavity is also concentric with the axial bore of the insert.

* * * * *